United States Patent [19]

Vander Ley

[11] 4,004,841

[45] Jan. 25, 1977

[54] FULL EXTENSION DRAWER GUIDE

[75] Inventor: Robert J. Vander Ley, Jenison, Mich.

[73] Assignee: Leslie Metal Arts Company, Inc., Grand Rapids, Mich.

[22] Filed: June 12, 1975

[21] Appl. No.: 586,209

[52] U.S. Cl. ..... 312/342; 312/339; 312/348; 308/3.8

[51] Int. Cl.[2] ..... A47B 88/00; F16C 21/00

[58] Field of Search ..... 312/342, 338, 333, 339, 312/337, 348, 332; 308/3.8

[56] References Cited

UNITED STATES PATENTS

| | | | |
|---|---|---|---|
| 1,135,235 | 4/1915 | Weiss | 312/339 |
| 1,534,201 | 4/1925 | Blin | 312/339 |
| 2,486,764 | 11/1949 | Singer | 312/348 |
| 2,614,022 | 10/1952 | Kurtzon | 312/348 |
| 2,692,802 | 10/1954 | Kurtzon et al. | 312/339 |
| 2,814,809 | 12/1957 | Boyle | 312/339 |
| 2,871,085 | 1/1959 | Diack | 312/339 |
| 2,926,048 | 2/1960 | Gussack | 312/339 |
| 3,462,203 | 8/1969 | Vecchio | 312/348 |
| 3,743,366 | 7/1973 | Tazaki | 312/339 |

FOREIGN PATENTS OR APPLICATIONS

| | | | |
|---|---|---|---|
| 522,087 | 7/1921 | France | 312/339 |
| 96,636 | 11/1922 | Switzerland | 312/339 |
| 801,255 | 9/1958 | United Kingdom | 312/339 |

*Primary Examiner*—Paul R. Gilliam
*Assistant Examiner*—Victor N. Sakran
*Attorney, Agent, or Firm*—McGarry & Waters

[57] ABSTRACT

A progressive action, full extension drawer guide which allows drawers to open completely, has first and second rails with recessed nesting portions and ball bearings therebetween for gliding of the second rail with respect to the first rail, and a third rail with roller guide means which fits within the recessed portion of the second rail. A friction roller is mounted for rotation on the second or middle rail and contacts tracks on the first and third rails to move the second rail progressively one-half the distance of movement between the first and third rails. Novel stops are provided to stop the movement of the first rail with respect to the second rail and to stop the movement of the second rail with respect to the third rail when the drawer is fully extended. The drawer guide is very compact so that it can be used on relatively shallow drawers.

7 Claims, 4 Drawing Figures

FULL EXTENSION DRAWER GUIDE

BACKGROUND OF THE INVENTION

1. Field of the Invention

This invention relates to a progressive action, full extension drawer guide for cabinets, desks and the like wherein a series of roller guided rails are provided to allow the drawer to extend completely from a cabinet to allow full access to the rear portion of the drawer.

2. State of the Prior Art

Full extension drawer guides are well known and are used to permit full extension of drawers such that the back of the drawer is fully accessible. Such drawer guides usually use three or more rails with one rail (cabinet rail) being attached to the cabinet, one rail (drawer rail) being attached to the drawer and one rail (floating rail) gliding between the drawer and cabinet rails. Examples of such drawer guides are disclosed in the United States Pat. Nos. to Card, 1,537,067, Tobey, 2,099,148, Schaffert, 1,129,831, and Bullock et al, 3,203,749. In these systems, rollers or ball bearings are provided on racks between the floating rail and the cabinet and drawer rails to provide free gliding movement between each of the rails.

One of the problems associated with such systems is that they tend to be rather large and bulky which limits their use on smaller drawers. Further, such systems are relatively complicated and difficult to fabricate.

Another problem with such systems is that the floating rail in some systems (Card) does not move until the drawer rail is completely extended. Thus, the rail operation is a two-step process: the drawer rail is first fully extended, the floating rail is then contacted by a stop on the drawer rail and drawn to its fully extended position. This type of system is undesirable in that it provides a relatively rough operation of the drawer glide.

Some systems (Wolters) use a roller mounted on the floating rail to ride on tracks of the cabinet and drawer rail so that the floating rail moves one-half the distance of the drawer rail with respect to the cabinet rail. In this system, however, difficulty is encountered in maintaining the relationship between the three rails because of slippage between the wheels and the track. This results in misalignment of the three rails which causes rough operation at the ends of travel of the drawer. When misalignment occurs, the control roller provides frictional resistance between sliding of the cabinet and the floating rails, for example, when the drawer rail is fully extended or near its retracted position.

SUMMARY OF THE INVENTION

According to the invention, a compact, simple, easily manufactured drawer guide has ball bearing glides between nested indented portions of first and second rails, roller bearing glides of a third rail in the indentation of the second rail and a friction roller between the first and third rails to control the movement of the second rail with respect to the first and third rails. The first elongated rail has an upright side and laterally projecting track flanges at upper and lower portions thereof forming an elongated indentation. The second rail has an elongated indented portion formed of upper and lower laterally projecting track flanges joined by an upright side portion with the indented portion of the second rail nesting closely within the indentation of the first rail so that the sides of the first rail and the second rail are closely adjacent one another. Roller bearing means, preferably ball bearings, are provided between the upper track flanges of the first and second rails and between the lower track flanges of the first and second rails so that the second rail slides freely with respect to the first rail. An upright roller flange projects vertically, preferably upwardly, from the outer edge of a second rail track flange and a friction roller, preferably with a high coefficient of friction surface, is rotatably mounted on the roller flange so that the roller rolls in contact with an outer surface of a first rail track flange. The third elongated rail has an upright side portion and a laterally extending track flange with the side portion being juxtaposed to the second rail. The track flange extends laterally over and in contact with the friction roller. Guide roller means are mounted on the upright side portion of the third rail and sized to fit within the second rail between the upper and lower track flanges thereof so that the third rail glides freely with respect to the second rail.

Desirably, the friction roller has an outer surface of a rubbery material to provide a relatively high coefficient of friction between the surface of the friction roller and the two flanges on which it rides. The rubber surface prevents slippage between the roller and the tracks on which it rides to assure even proportional movement of the second rail with respect to the first and third rails.

A gravity operated lever is pivotably mounted on the upright roller flange of the second rail and has a stop portion which engages a slot in the track of the third rail when the drawer reaches its full extent of travel. Release of the lever allows the drawer to be removed from the cabinet.

The roller bearings between the first and second rails have spacers therebetween and stops are provided at the ends of the tracks containing the roller bearings to prevent removal thereof. In this manner, the movement of the first rail with respect to the second rail is limited when the drawer is fully extended.

These and other features and advantages of the present invention will hereinafter appear for purposes of illustration but not for limitation. A preferred embodiment of the present invention is described in detail below and shown in the appended drawings.

DETAILED DESCRIPTION OF THE PREFERRED EMBODIMENT

Figure 1:
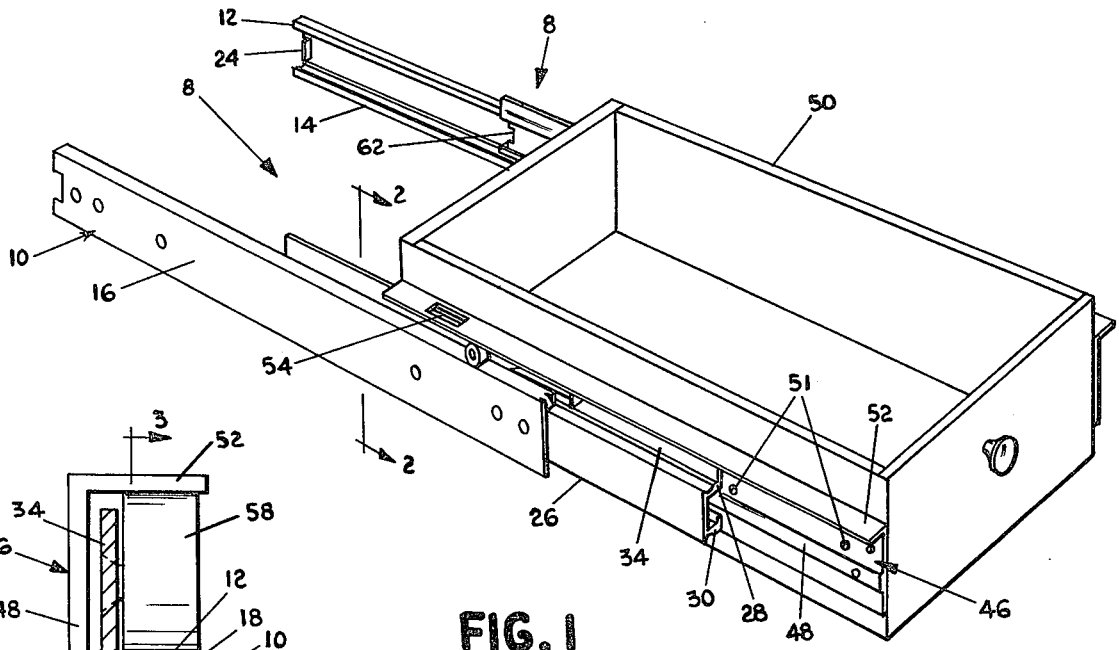
FIG. 1 is a perspective view of a drawer guide according to the invention with the drawer guide mounted on a drawer.

Referring now to the drawings and to FIG. 1 in particular, there is shown a full extension drawer guide 8 mounted on opposite sides of a drawer 50. The drawer guide is particularly designed for use in kitchen cabinets and desks for supporting the drawer 50 whereby the full contents of the drawer will be accessible outside the cabinet. The drawer guide 8 comprises a cabinet rail 10, floating rail 26 and drawer rail 46 telescopically and nestingly mating together to form a compact drawer guide. The cabinet rail 10 is normally attached to the side of a cabinet (not shown) through screws (not shown) which extend through holes 11. The drawer rail 46 is secured to the drawer 50 through screws 51 which extend through holes conveniently placed in the side of the drawer rail 46.

Figure 2:
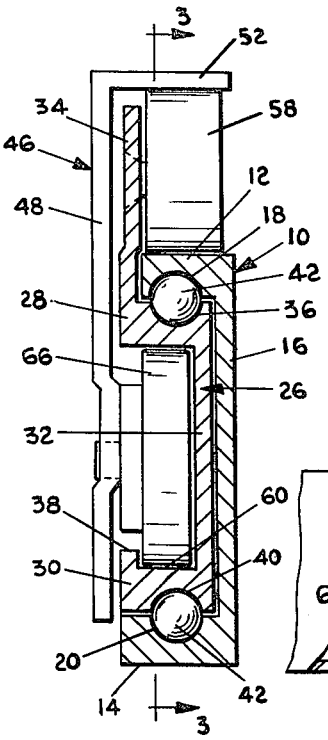
FIG. 2 is a sectional view taken along lines 2—2 of FIG. 1.

As seen in FIG. 2, cabinet rail 10 is indented or C-shaped in cross-section and has an upper lateral track flange 12 and a lower lateral track flange 14, both of which extend outwardly at 90° from a side member 16. The upper lateral flange 12 has a downwardly facing groove 18 positioned on its lower surface and forming a portion of a ball bearing raceway. The lower lateral flange 14 has a groove 20 positioned on its upper surface, forming a portion of another ball bearing raceway.

The floating rail 26 is also indented and has an upper lateral track flange 28 and a lower lateral track flange 30, both of which extend laterally from side member 32. The upper lateral flange 28 has a vertical roller mounting flange 34 at its outer edge extending upwardly at 90° to the upper lateral flange 28. Flange 34 mounts a friction roller 58 which rides on the top surface of the cabinet rail track flange 12. The upper lateral flange 28 has an elongated groove 36 on its upper surface forming a portion of the upper ball bearing raceway. The track flange 30 has an elongated groove 40 on its lower surface forming a portion of the lower ball bearing raceway. The lower track flange 30 further has a vertical retaining flange 38 on its inner surface at its outer edge extending upwardly at 90° to the lower flange for forming a roller track 60 for rollers 58. Ball bearings 42 and separators 44 are positioned in each of the raceways between the cabinet rail 10 and the floating rail 26 for free sliding movement therebetween.

Figure 4:
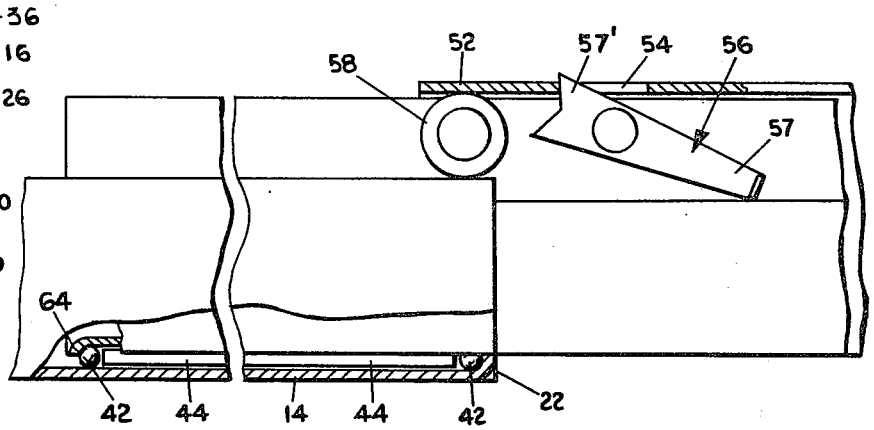
FIG. 4 is a partial view of the drawer guide showing the stop mechanism in operative position when the drawer is fully extended.
Figure 3:
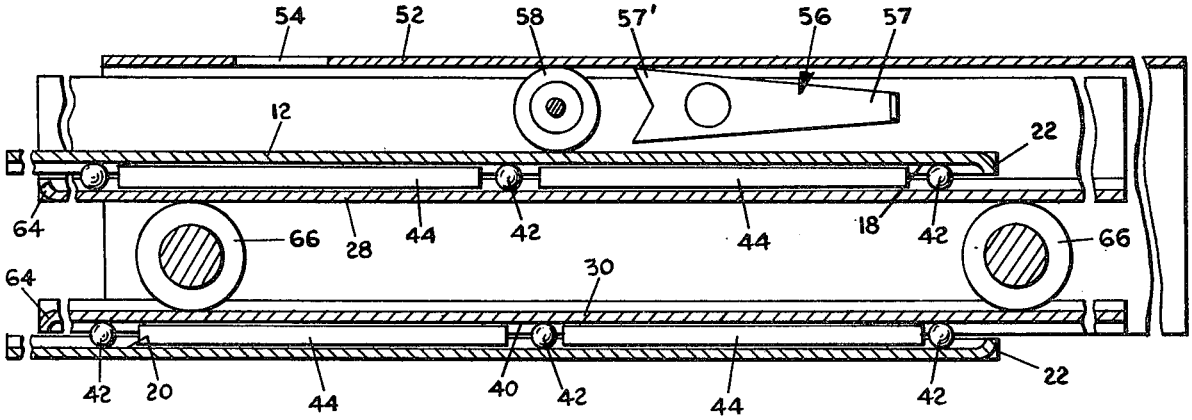
FIG. 3 is a sectional view taken along lines 3—3 of FIG. 2.

As seen in FIG. 3, the ends of the radial grooves 18 and 20 in the cabinet rail 10 are flared in toward the grooves at the front to form tabs 22. The radial grooves 36 and 40 in the floating rail 26 are flared in toward the grooves at the rear end forming tabs 64 for retaining ball bearings 42 and ball separators 44 in the raceways. As seen in FIG. 4, the tabs 64 and 22 provide stops with the ball bearings and separators for the cabinet rail when the floating rail 26 is fully extended.

As seen in FIG. 1, a stop 24 is provided at the back edge of the cabinet rail 10. This stop 24 fits into indentation 62 in the floating rail 26 to limit the rearward movement of the floating rail 26. The stop also extends into the indented portion between track flanges 28 and 30 of the floating rail 26 so as to contact the rearmost of the wheels 58 when the drawer rail 46 is in its retracted position. Thus, the stop 24 prevents rearward movement of the floating rail 26 and the drawer rail 46 past a predetermined point which is the point at which the drawer is fully retracted in the cabinet.

Referring again to FIG. 2, drawer rail 46 is made of a single piece of sheet metal with a vertical member 48 having a lateral track flange 52 extending outwardly at 90° from a top portion thereof over and in contact with the friction roller 58. Flange 52 has a rectangular slot 54 near the rear of the flange.

The drawer rail 46 rotatably mounts two guide rollers 66 which are positioned between the track flanges 30 of the floating rail 26. The rollers 66 are sized to roll on the undersurface of track flange 28 and on the upper surface of track flange 30. Flanges 38 retain the rollers 66 between these two track flanges. The drawer rail 46 thus glides freely with respect to the floating rail 26 on rollers 66.

A gravity operated stop lever 56 is pivotably mounted on floating rail upper vertical flange 34. The stop lever has a heavier end 57 and a stop end 57′, the latter of which engages the slot 54 as shown in FIG. 4, stopping the outward travel of the drawer 50, when the drawer is fully extended. The weight of the forward portion 57 of the lever 56 causes the stop 57′ to engage the slot automatically as the drawer is pulled out, thereby eliminating the hazzard of pulling the drawer out of its support. As the drawer is closed, lever 56 disengages from the slot 54 by the camming action of the edge of the slot against the side of the lever.

The friction roller 58 is desirably formed with an outer surface of a rubber or similar high friction material to provide a relatively high coefficient of friction between the surface of the roller and the upper track flange 52 and between the surface of the roller 58 and the track flange 12 of the cabinet rail 10. Thus, slippage between the friction roller 58 and the cabinet rail 10 and between the friction roller 58 and the drawer rail 46 are avoided under ordinary use. Natural and synthetic rubbers, including polymers of silicon and hydrocarbon can be used for the rubbery material. The friction roller 58 can be made completely of rubber or can be made of plastic or metal with a rubbery material coated or applied to the outer surface thereof.

In operation, as the drawer is pulled out, the drawer rail 46 rolls on guide rollers 66 for movement of the drawer rail 46 with respect to the floating rail 26. At the same time, track flange 52 engages the friction roller 58 to cause rotation hereof on the top of the upper track flange 12 of the cabinet rail 10. Rotation of the friction roller 58 thus drives the floating rail 26 which glides on the ball bearings 42. Thus, the floating rail 26 moves progressively through a displacement of one-half the distance of the drawer rail 46 with respect to the cabinet rail 10.

As the drawer reaches the end of its travel, the stop end 57′ of lever 56 will project through the opening 54 in the track flange 52, thereby limiting further movement of the drawer rail 46 with respect to the floating rail 26. At the same time, the ball bearings 42 and the separators 44 will come together with the upturned ends 22 of the flanges 12 and 14 being positioned against the forwardmost of the ball bearings 42 and the tabs 64 on flanges 28 and 30 being positioned against the rearmost of the ball bearings 42. In this position, further outward movement of the floating rail 26 with respect to the cabinet rail 10 is precluded.

As the drawer is pushed back in, the lever 56 will be disengaged from the slot 54 and the rails continue to move backward until the inwardly turned stops 24 on the cabinet rails 10 engage the indented portions 62 of the drawer rail 46.

Whereas the invention has been described with respect to a drawer rail of a particular configuration and a cabinet rail of another configuration, it is obvious that the cabinet rail 10 can be mounted on the drawer and the drawer rail 46 can be mounted on the cabinet with similar results. In addition the friction roller 58 can be mounted beneath the track flange 14 with the drawer track flange 52 extending beneath the friction roller instead of above the same, if desirable.

Reasonable variation and modification are possible within the scope of the foregoing disclosure and drawings without departing from the spirit of the invention which is defined in the accompanying claims.

The embodiments of the invention in which an exclusive property or priviledge is claimed are defined as follows:

1. A drawer guide for cabinet drawers and the like comprising:

a first elongated rail having an upright side and laterally projecting track flanges at the upper and lower portions thereof.

a second rail having an elongated indented portion formed of upper and lower laterally projecting track flanges joined by an upright side portion with the indented portion of the second rail nesting closely within the first rail so that the sides of the first rail and the second rail are closely adjacent to one another;

roller bearing means between the upper track flanges of the first and second rails and between the lower track flanges of the first and second rails so that the second rail slides freely with respect to the first rail;

a roller flange projecting vertically from the outer edge of a second rail track flange past one of said first rail track flanges;

a friction roller rotatably mounted on said roller flange so that said roller rolls in contact with a surface of a first rail track flange;

a third elongated rail having an upright side portion and a laterally extending track flange, said side portion being juxtaposed to said second rail and said second track flange extending laterally over and in contact with said friction roller;

guide roller means mounted on said upright side portion of said third rail, sized to fit and positioned within said second rail between the upper and lower track flanges thereof so that the third rail glides with respect to said second rail;

whereby as said first rail is moved with respect to said third rail, said friction roller moves said second rail one-half the distance of the first rail with respect to the third rail.

2. A drawer guide according to claim 1 wherein said friction roller has an outer surface of a rubbery material to provide a relatively high coefficient of friction between the surface of the friction roller and the track flange of the first rail and between the surface of the roller and the track flange of the third rail.

3. A drawer guide according to claim 1 and further comprising stop means for limiting the travel of the second rail with respect to the third rail.

4. A drawer guide according to claim 3 wherein said stop means includes a lever pivotably mounted on said second rail upright roller flange near one end of said second rail, said lever having a weighted end directed away from the one end of the second rail, and a stop end with the weighted end being heavier than the stop end so that the stop end is in contact with the lower side of the track flange of the third rail; and an opening in said third rail track flange positioned to pass said stop end, thereby preventing further movement of the third rail with respect to the second rail in one direction of travel without disengagement of the lever from the opening.

5. A drawer guide according to claim 1 wherein said guide roller means comprises two rollers mounted on said third rail and adapted to roll on the lower surface of the second rail upper track flange and on the upper surface of the second rail lower track flange.

6. A drawer guide according to claim 1 and further comprising means for limiting movement of the first rail with respect to the second rail between a first position wherein one end of each of the first and second rails are adjacent one another to a second position wherein one end of the rail is intermediate the ends of the first rail.

7. A drawer guide according to claim 6 wherein the movement limiting means for the second position includes retainers at the end of the track flanges of the first and second rails to retain the roller bearing means therein and spacers between the roller bearing means between the track flanges.

* * * * *